US008331846B2

(12) United States Patent
Kato

(10) Patent No.: US 8,331,846 B2
(45) Date of Patent: Dec. 11, 2012

(54) BOOK BINDING SYSTEM

(75) Inventor: Norishige Kato, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1015 days.

(21) Appl. No.: 11/839,344

(22) Filed: Aug. 15, 2007

(65) Prior Publication Data

US 2008/0267733 A1 Oct. 30, 2008

(30) Foreign Application Priority Data

Apr. 26, 2007 (JP) ..... 2007-116540

(51) Int. Cl.
*G03G 15/00* (2006.01)
*B42C 9/00* (2006.01)
*B42C 13/00* (2006.01)

(52) U.S. Cl. ..... 399/408; 412/8; 412/9; 412/11

(58) Field of Classification Search ..... 399/408; 412/8, 9, 11, 14
See application file for complete search history.

(56) References Cited

U.S. PATENT DOCUMENTS 4,904,138 A * 2/1990 Champeaux et al. ..... 412/8
5,013,200 A * 5/1991 Hunder et al. ..... 412/6
6,592,056 B2 * 7/2003 Yamakawa et al. ..... 239/569
7,448,837 B2 * 11/2008 Oota ..... 412/37
7,783,245 B2 * 8/2010 Nakamichi et al. ..... 399/408
2005/0232656 A1 * 10/2005 Asai et al. ..... 399/130
2006/0137604 A1 * 6/2006 Gambini ..... 118/230
2006/0238786 A1 * 10/2006 Sakura et al. ..... 358/1.9
2008/0056735 A1 * 3/2008 Sorita et al. ..... 399/1
2008/0056847 A1 * 3/2008 Hattori et al. ..... 412/8

FOREIGN PATENT DOCUMENTS

JP 04331190 A * 11/1992
JP 11-011043 1/1999
JP 2004-209870 7/2004
JP 2005-047199 2/2005

OTHER PUBLICATIONS

Japanese Office Action dated May 26, 2009.

* cited by examiner

*Primary Examiner* — Matthew G Marini
*Assistant Examiner* — Allister Primo
(74) *Attorney, Agent, or Firm* — Finnegan, Henderson, Farabow, Garrett & Dunner, L.L.P.

(57) ABSTRACT

A book binding system comprising an image forming apparatus for forming images on a sheet, a book binding apparatus having a coating section for coating adhesive onto the spine of a sheet bundle and forming a booklet by coating adhesive and binding a plurality of sheets on which images have been formed at the image forming device, and a coating control section for controlling a coating amount of the adhesives of the coating section in accordance with the sheet type.

18 Claims, 4 Drawing Sheets

BOOK BINDING SYSTEM

RELATED APPLICATION

This application is based on Japanese Patent Application No. 2007-116540 filed on Apr. 26, 2007 in Japan Patent Office, the entire content of which is hereby incorporated by reference.

TECHNICAL FIELD

This invention relates to a book binding system, and more particulary to a book binding system which performs continuous steps from image formation to book binding.

BACKGROUND TECHNOLOGY

In recent years book binding systems which perform continuous steps from image formation to book binding using an electrophotographic type image forming apparatus have been developed and are being used.

This type of book binding system is required to be small in size since it is used in offices or other locations similar to the office environment. For this reason, adhesion processing devices which have bonds such as those in Patent Documents 1 and 2 are widely used as a processing apparatus in which a plurality of sheets are stacked to form a booklet.

Patent Documents 1 and 2 disclose a technique in which, when the spine of a plurality of sheets is coated with adhesive and the papers are bonded together to form a booklet, the coating frequency is changed in accordance with the thickness of the booklet and thus booklets of different thickness have a prescribed adhesive strength.

[Patent Document 1] Unexamined Japanese Patent Application Publication No. 2000-168265

[Patent Document 2] Unexamined Japanese Patent Application Publication No. 2004-209753

In adhesion processing with bond, there is a problem in that adhesive strength varies depending on the type of paper.

Adhesion processing with bond includes the process of stacking and aligning a plurality of sheets of paper to thereby line up the spines of the sheet stack and applying adhesive to the spine using a coating section such as a coating roller or the like.

In regular paper, it is easy to infuse into the paper with the adhesive, and also a suitable space is formed between the sheets of paper and this space becomes infused with adhesive. For this reason, in regular paper, even with a small amount of adhesive, the sheets can be bonded to each other with high adhesive strength.

Meanwhile, in coated paper or high quality paper, it is difficult for the paper to be infused with adhesive due to the quality of the paper and the smoothness of the surface, and the spine of the paper stack that have been aligned is flat with little unevenness, and because it is difficult for space between the sheets of paper to become infused with adhesive, the adhesive strength is sometimes insufficient.

As is the case in Patent Documents 1 and 2, by only changing coating frequency in accordance with booklet thickness, booklets which have different adhesive strength depending on the type of paper are created and this is problematic in terms of insufficient strength and excess coating.

SUMMARY

One aspect of the present invention is a book binding system comprising an image forming apparatus for forming images on a sheet, a book binding apparatus having a coating section for coating adhesive onto the spine of a sheet bundle and forming a booklet by coating with an adhesive and binding a plurality of sheets on which images have been formed at the image forming device, and a coating control section for controlling a coating amount of the adhesive of the coating section in accordance with the sheet type.

DESCRIPTION OF THE PREFERRED EMBODIMENTS

Figure 1:
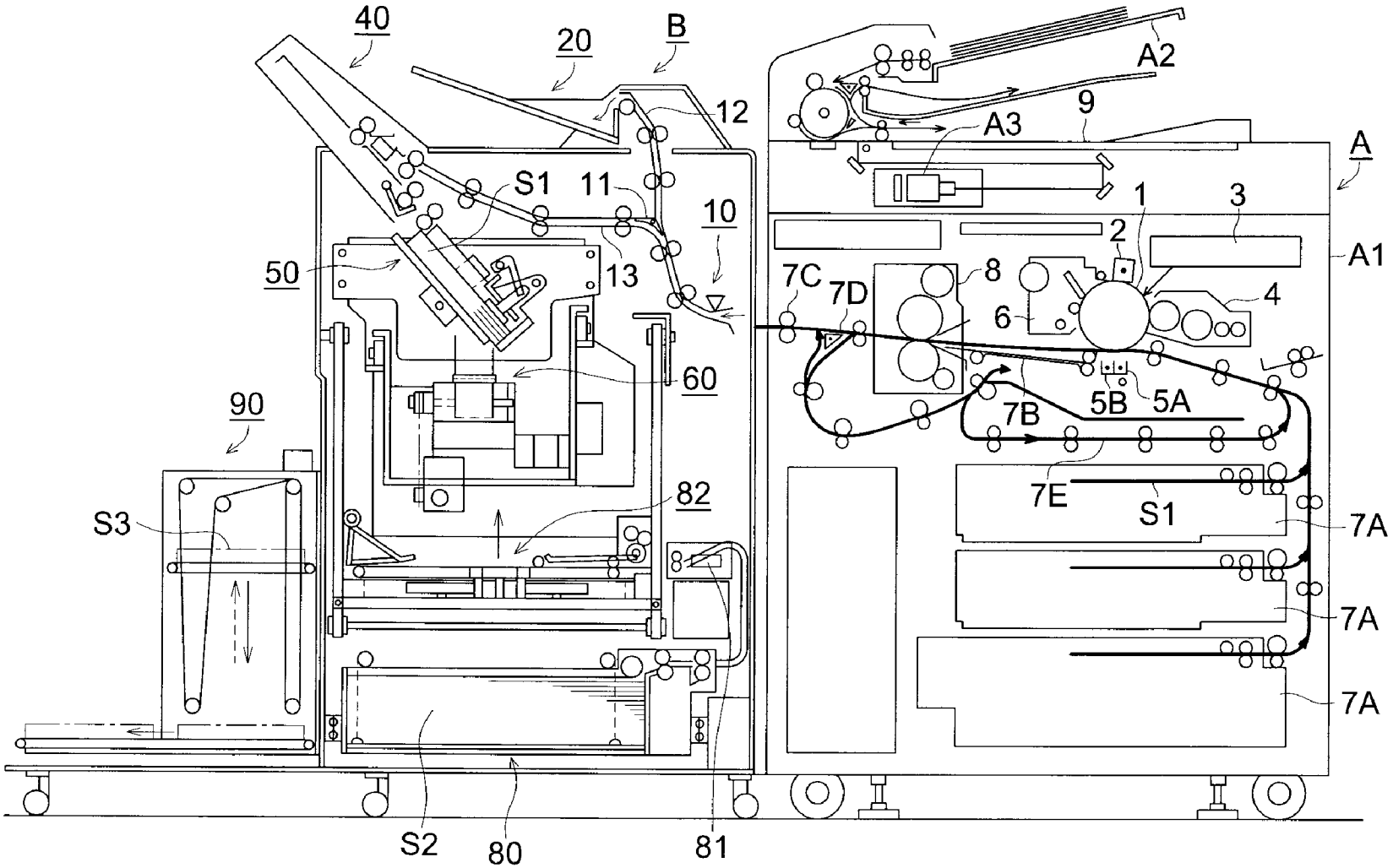
FIG. 1 shows the entire book binding system of an embodiment of this invention.

The present invention will be described using the embodiment shown in the drawing, but the invention is not to be limited thereto.

FIG. 1 shows the entire book binding system of an embodiment of this invention.

The book binding system comprises an image forming apparatus A and a book binding apparatus B. However, the image forming apparatus is not limited to an electrophotographic type apparatus and may also be an ink jet type apparatus.

The image forming apparatus A is one which forms images on paper using an electrophotographic system and comprises image forming section A1, a document conveyance section A2, and am image reading section A3.

In the image forming section A1, the charger 2, the exposure device 3, the developing device 4, the transfer device 5A, the separation device 5B and the cleaning device 6 are arranged around the periphery of the drum-like photoreceptor 1, and charging, exposure, development and transfer are performed by these electrophotographic processing devices and toner images are formed on the photoreceptor 1 and images are formed on the sheet S1.

The sheets S1 are stored in 3 sheet feeding trays 7*a* and the sheets S1 are feed one sheet at a time from these sheet feeding trays 7A, and the toner image on the photoreceptor 1 are transferred to the sheet S1 by the transfer device 5A.

The toner image that is transferred to the sheet S1 passes through the fixing device 8 and is subjected to fixing processing. The sheet S1 that has been subjected to fixing processing is ejected from the ejection roller 7C or conveyed to the paper re-feeding path 7E.

In face down sheet ejection of one-side printing, face-up sheet ejection of one-side printing, or surface image formation for both side image formation, the switching gate 7D switches and guides the sheet S1. That is to say, in face-up sheet ejection, the switching gate 7D causes the sheet S1 to advance straight, and in face down sheet ejection, the switching gate 7D guides the sheet S1 downward.

In face-down sheet ejection, after the sheet S1 is guided downward, it is switched back and conveyed upward and ejected from the sheet ejection roller 7C.

In both side image formation, the sheet S1 is guided downward and after the back and front are inverted by switch back, it is re-fed to the transfer section which is disposed in the transfer device 5A via the sheet re-feeding section 7E and transferring of the back surface image is performed.

In the document conveyance device A2, one sheet at a time is conveyed to the reading device. The image reading section A3 reads the images on the document that is conveyed by the document conveyance device A2, or the document that is loaded on the document table 9 and creates image signals.

The book binding apparatus B is an apparatus which stacks a plurality of booklet component sheets that are sent in from the image forming apparatus A to form the booklet component sheet stack, and bonds cover sheets to the stack to form a booklet. In the following description, the booklet components sheets are called S1 and the cover sheets are called S2, and the booklet component sheets that are covered with the cover sheets is called S3.

The book binding apparatus B comprises a conveyance section 10 which conveys the ejected sheet S1 from the image forming apparatus A to the sheet feeding tray 20 or to the sheet inversion section 40, a sheet ejection tray 20, a sheet inversion section 40, a stacking section 50 which stacks sheets S1 which, up until that point, have been sent one sheet at a time, or in sets of a plurality of sheets, a coating section 60, a cover sheet storage section 80 which stores sheets S2, a cover sheet storage section 80 which stores the cover sheets S2; a cover sheet support section 82 which supports the cover sheets and a booklet ejection section 90.

The sheet S1 which has been ejected from the image forming apparatus A is ejected to the sheet ejection tray 20 via the ejection path 12 by the switching gate 11 that is provided in the conveyance section 10, or conveyed to the sheet inversion section 40. The sheet is ejected to the sheet ejection tray 20 when the book binding mode is not set.

In the book binding mode, the sheet S1 is conveyed to the sheet inversion section 40 via the conveyance path 13 and after being switched back in the sheet inversion section 40, it is conveyed to the stacking section 50. In the stacking section 50, the number of sheets S1 comprising 1 booklet are stacked and at the stage where the number of booklet component sheets are stacked, the stacking section 50 rotates and the stack of sheets S1 are held in a substantially perpendicular state.

The sheet inversion section 40 which is a buffer between the image formation section A and the stacking section 50, stacks the sheets.

That is to say, the sheets are continuously ejected from the image forming section A, and the book binding apparatus B performs the book binding step after the number of component sheets of the booklet has been stacked and thus in the stacking section 50, after stacking of the number of component sheets of the booklet is complete, a prescribed length of time is required until the next sheets can be accepted.

The sheet inversion section 40 stacks the sheets ejected from the image forming apparatus A during this time interval.

Adhesive is coated by a coating section 60 on the lower surface of the sheet S1 stack that is held in a perpendicular state by the stacking section 50.

The cover sheet S2 is bonded on the sheet S1 stack on which the adhesive was coated.

The booklet S3 which is formed by the cover sheet S2 being bonded on the sheet S1 stack is ejected to the booklet ejection section 90.

Figure 2:
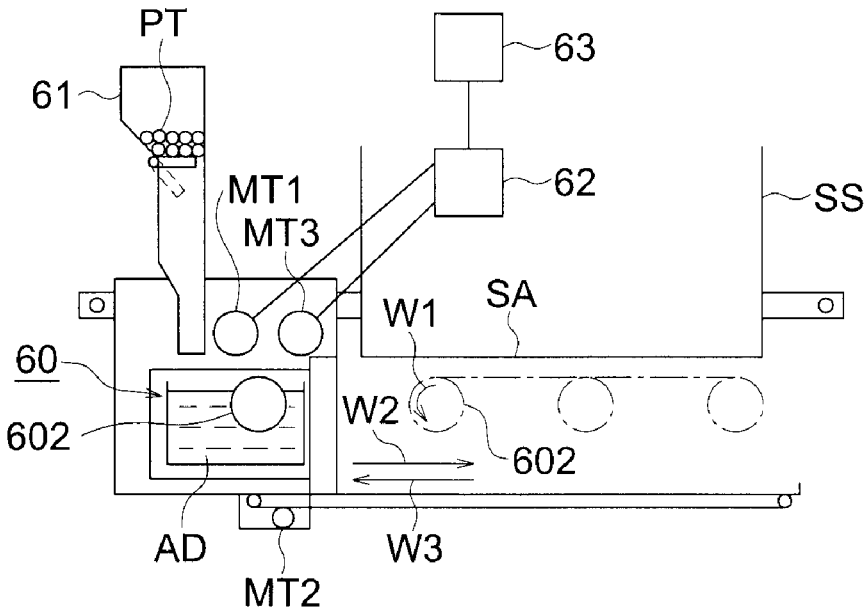
FIG. 2 shows the coating step.

FIG. 2 shows the coating step.

The coating section 60 is placed below the sheet S1 stack SS, and at the time of forward motion in the direction shown by arrow W2 due to the driving of the motor MT1 which is the driving section, the coating roller 602 coats adhesive AD on the spine SA of the sheet stack SS, and at the time of backward motion in the direction shown by arrow W3 also, the coating roller 602 coats adhesive AD on the spine SA.

The home position of the coating section 60 is the left end position in FIG. 2, and when viewed from the front of the book binding apparatus B of FIG. 1, it is positioned in the depth direction, and the adhesive pellet from the supply device 61 is supplied at this home position. The coating roller 602 rotates in the direction shown by arrow W1 due to the driving of the motor MT2 at the time of forward and backward motion and adhesive is pumped from the adhesive tank 601 and coated on the spine SA of the sheet stack SS.

Figure 3:
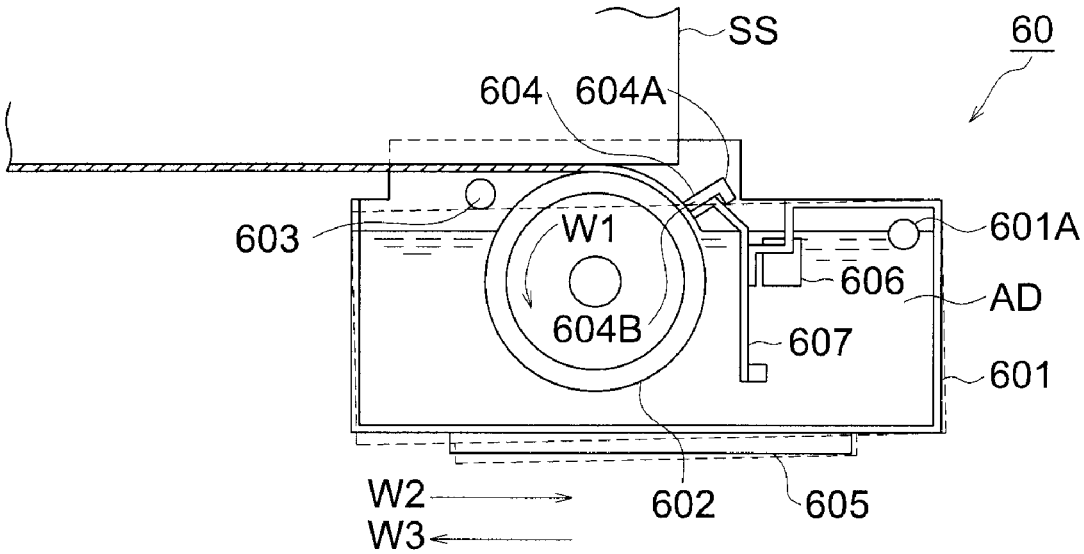
FIG. 3 shows the structure of the coating section 60.

FIG. 3 shows the structure of the coating section 60.

The coating section 60 comprises an adhesive tank 601 for storing the adhesive AD, a coating roller 602, control members 603 and 604, a heater 605 and an adhesive amount sensor 606.

The pellet inside the adhesive tank 601 is formed from a hot melt adhesive and it is heated by the heater 605 to melt and form a coating solution of the adhesive AD, and the amount of the adhesive AD is detected by the adhesive sensor 606 which comprises a temperature sensor so that the solution surface is kept fixed. The control member 604 is supported by a plate-like support member 607 and the layer thickness of the adhesive on the coating roller 602 is controlled by the lower end edge 604B of the control member 604, and the layer thickness of the adhesive on the spine SA of the sheet bundle is controlled at the upper end edge 604A.

The control member 603 controls the thickness of the coating layer when the coating section 60 moves in the direction shown by the arrow W2 and performs coating. In addition, the control portion 604A of the control member 604 controls the thickness of the coating layer when the coating section 60 moves in the direction shown by the arrow W3 and performs coating.

The adhesive tank 601 rotates around the shaft 601A from the standby state shown by the dotted line to the coating state shown by the solid line and is thereby set.

Coating of adhesive AD for one sheet stack SS is complete when the backward and forward motion of the coating section along the spine SA of the sheet stack SS is performed one time or multiple times.

The coating section 60 performs coating at the time of forward motion and the time of backward motion and thus coating is performed by one back and forth movement and a uniform coating layer is thereby formed, and by repeating the step of performing coating at the time of forward motion and the time of backward motion, one uniform coating layer is formed.

Furthermore, in forward motion coating and backward motion coating respectively, by controlling the coating layer thickness using the control member 603 and 604, the coating uniformity is further improved.

The coating layer can be adjusted by adjusting the height of the coating section 60 or by adjusting the height of the control member 603 or 604.

It is to be noted that in this embodiment, the coating frequency for one sheet bundle SS is controlled by performing one back and forth motion of the coating section 60 one time. However, given that a coating in which the coating section 60 is moved once in one direction relative to the sheet stack SS is a coating frequency of 1, the coating frequency may be controlled such that forward motion and backward motion have a frequency of one respectively as in the case of one time coating in which coating is performed only in the forward motion or the backward motion; two time coating at the time of forward and backward motion; and four time coating in which coating is performed at the time of two forward and backward motions. By controlling the coating frequency in this manner, it becomes possible to control the coating layer thickness more specifically.

In order to perform coating by only one of forward motion and backward motion, at the time of coating, the coating layer 601 is moved in one direction in a set state to the position shown by the solid line in FIG. 3, and at the time when there coating is not being done, the coating layer 601 may be set at the position shown by the broken line in FIG. 3 and moved in the opposite direction.

In the adhesive coating step, the book binding apparatus control section 200 which is the coating control section drives the motor MT1 and the coating section 60 performs coating by being moved back and forth as shown by arrows W2 and W3, but based on the paper type information from the image forming apparatus control section 100 (see FIG. 4) which is the control section for the image forming device A (shown in FIG. 1), the coating frequency may, for example, be selected as shown above. Furthermore, the motor MT2 is controlled and the rotation speed of the coating roller 602 is thereby controlled.

Figure 4:
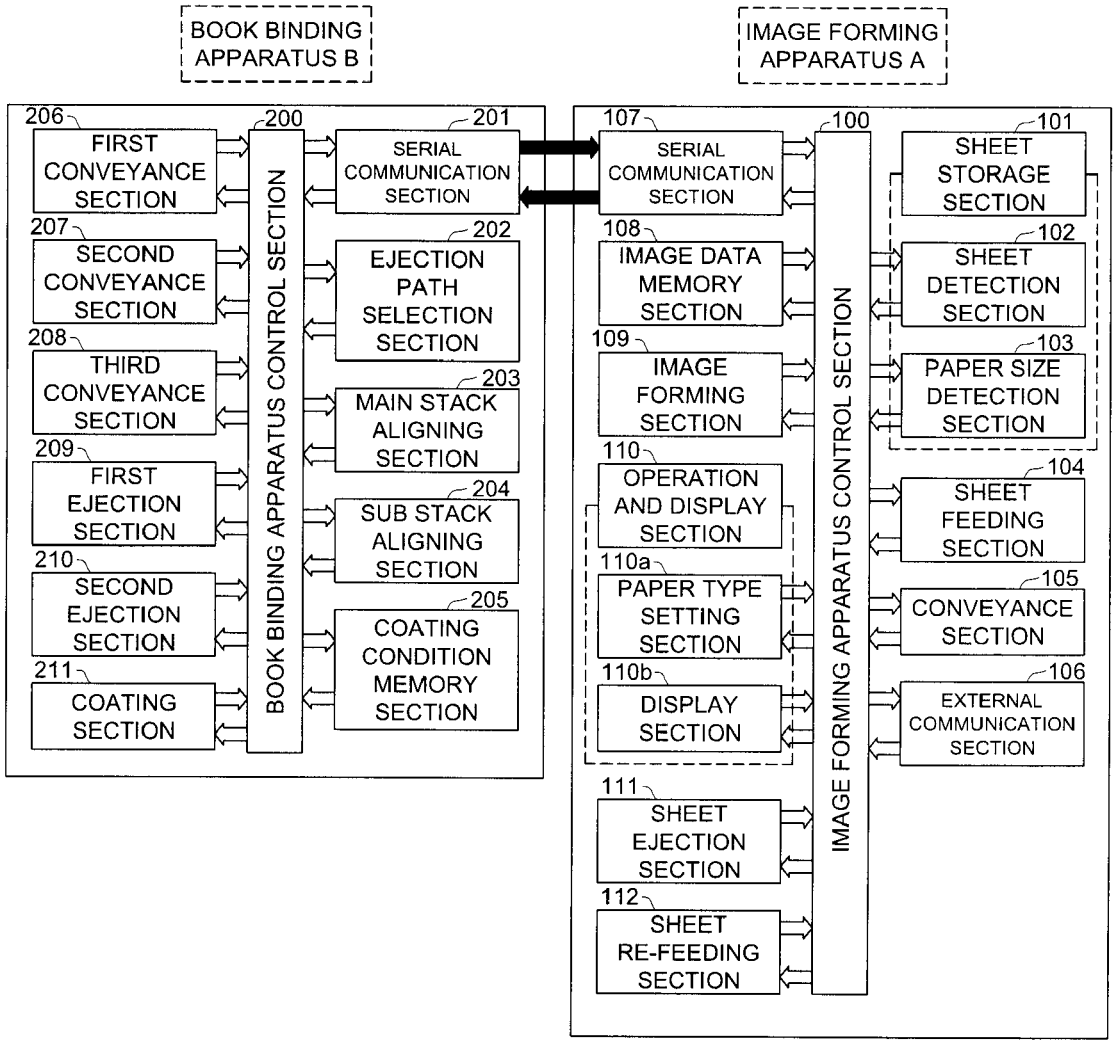
FIG. 4 is a block diagram of the control system of the book binding system shown in FIG. 1.

FIG. 4 is a block diagram of the control system of the book binding system shown in FIG. 1. The control system of FIG. 4 is described with reference to FIG. 1.

The sections of the image forming apparatus control section 100 of the image forming apparatus A are connected by a bus.

101 is the sheet storage section, and it comprises a detection section 102 for detecting whether there are sheets present in the supply tray 7A and a sheet size detection section 103.

104 is the sheet feeding section which conveys the sheets from the sheet feeding tray 7A and 105 is the conveyance section for conveying the sheets to the image forming section A1.

106 is the external communication section for communicating with external devices via a network.

108 is the image data memory section for storing image data created by the image reading section A3 and image data received from external devices and 109 comprises the photoreceptor 1 or the like and is an image forming section for forming images on the sheet. 110 is an operation and display section in which various conditions are set by operation by the user, and is a user interface which does various displays and comprises the sheet type setting section 110*a* which set the sheet type and the display section 110*b*.

111 is a paper ejection section which ejects sheets and then sends them to the processing device B.

112 is the re-feeding section which performs sheet feeding when images are to be formed on the back surface.

The sections of the book binding apparatus control section 200 of the book binding apparatus B are connected by a bus.

202 is an ejection path selection section which controls the switching gate 11 which selects the conveyance path 12 or the conveyance path 13. 203 is the main stack aligning section for aligning sheets in the stacking section 50 and 204 is a sub stack aligning section for aligning sheets in the sheet inversion section 40.

205 is a coating condition memory section for storing the coating conditions wherein data for coating frequency of the coating section 60 and coating speed of the coating rollers are stores.

An example of the coating conditions stored in the coating condition memory section 205 is shown in Table 1.

TABLE 1

| | Paper type | | | | |
|---|---|---|---|---|---|
| | Regular type | Recycled paper | Colored paper | High grade paper | Coated paper |
| Coating roller rotation speed | 100 mm/s | 200 mm/s | 200 mm/s | 200 mm/s | 300 mm/s |
| Coating frequency | 1 back and forth motion | 1 back and forth motion | 2 back and forth motions | 3 back and forth motions | 3 back and forth motions |

The coating conditions shown in Table 1 include coating frequency and the coating roller rotation speed.

The higher the coating frequency or the coating roller rotation speed, the more the coating amount will be. It is to be noted that the coating roller rotation speed is the rotation speed of the coating roller 602 which is driven by the motor MT2 (See FIG. 2 and FIG. 3).

For regular paper, the coating solution can be easily infused into the paper, and also because it can easily infuse between one sheet and another, the sheets can be firmly bonded together with a small amount of coating.

However, for coated paper and high grade paper, it is difficult for the coating solution to infuse into the paper. In addition, the spine of the sheets that have been stacked and aligned is flat and has little unevenness in coated paper and the like, and thus it is difficult for coating solution to be infused between the sheets.

For this reason, for coated paper and the like, the coating conditions are set such that the coating amount is large.

Furthermore, it is preferable that the coating points are in accordance with the thickness of the booklet, or in other words the number of sheets which form the booklet. It is preferable that the adhesive strength is made high to the extent that the booklet is thick, and this condition can be satisfied by causing the coating conditions to correspond with the thickness of the booklet.

It is to be noted that as shown in Table 1, the relationship between paper quality and coating conditions changes when the adhesive used is changed, but in this case, content stored in the coating conditions memory section 205 can be written in.

The type of paper is set in the paper type setting section 110*a*, or alternatively it may be included in the job command from external devices received in the external communication section 106.

In image forming and book binding, there is a mixed mode which uses multiple types of papers.

In this case, it is preferable that the coating conditions are set based on the paper type which requires the greatest amount of coating. For example, in the case where regular paper and coated paper is used to perform image formation and book binding, it is preferable that the coating conditions for coated paper are set.

As a result, in the mixed mode also, paper binding process can be performed such that sufficient adhesive strength is obtained.

206 is the first conveyance section which conveys sheets to the sheet inversion section 40 on the conveyance path 13; 207 is the second conveyance section which conveys sheets to the ejection tray 20 on the conveyance path 12; and 208 is the third conveyance section which conveys cover sheets from the cover sheet storage section 80.

209 is the first ejection section which ejects sheets to the ejection tray 20; 210 is the second ejection section which ejects booklets to booklet ejection section 90; and 211 is the coating section (equivalent to the coating section 60 in FIG. 2 and FIG. 3).

The image forming apparatus A and the book binding apparatus B communicate by the serial communication sections 107 and 201 and send and receive control signal and status detection signals.

In this invention, by controlling the coating amount of the adhesive in accordance with paper type, the problem of differing adhesive strength is solved and it becomes possible to create a booklet with uniform adhesive strength.

The steps of forming images on the sheets, stacking the sheets on which the images have been formed, and bonding the plurality of sheets that have been stacked to create a booklet will be described.

Figure 5:
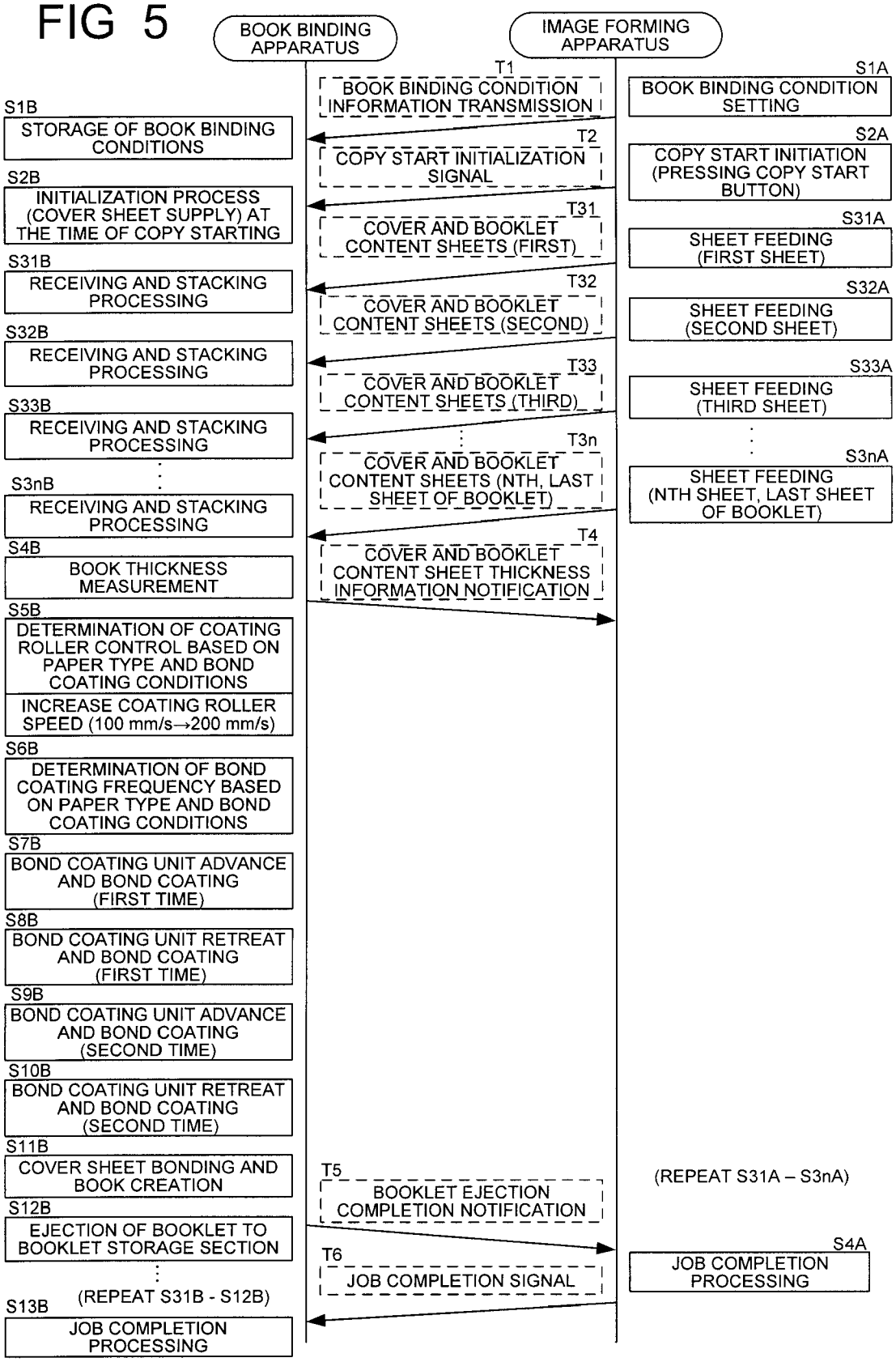
FIG. 5 is a sequence chart of the steps from image formation to book binding.

FIG. 5 is a sequence chart of the steps from image formation to book binding.

SA indicates the steps performed in the image forming apparatus A; SB indicates the steps performed in the book binding apparatus B; and T represents information and sheets sent between the image forming apparatus A and the book binding apparatus B.

The book binding conditions are set in Step S1A. These book binding conditions include the type of paper used, paper size, number of copies, one side or two side printing and the like.

The types of paper include regular paper, colored paper, high grade paper and coated paper.

There are four types of one side/two side combination in the relationship between the document and the copy and these are: one side (document)/one side (copy), one side/two sides, two sides/one side, two sides/two sides.

The book binding condition information T1 is transmitted to the book binding apparatus B and stored (S1B).

In the image forming apparatus A, copying is started by pressing the copy button (S2A) and the copy start signal T2 is transmitted to the book binding apparatus B and the book binding apparatus control section 200 performs initialization based on this signal (SB2).

The sheets are successively fed in S31A-S3*n*A and images are formed on each of the sheets.

The book manufacturing apparatus B receives sheets from the image forming apparatus A and successively stacks them one sheet at a time in the stacking section 50 (S31B-S3*n*B).

The number of sheets comprising one booklet is a value that is determined by the number of sheets of documents read in the image reading section A3 or the number of sheet of the document included in the image data that is received from the outside.

It is to be noted that in the case of two-side image formation, images are formed on ½ the number of sheet of the number of pages of the document, and a number of sheets that is determined by the number of the sheets in the document or by the amount of image data is conveyed to the book binding apparatus B, and at this stage, stacking of the sheets that comprise one booklet is complete.

At the stage where the stacking of the sheets is complete and alignment and sandwiching of the sheet stack in the stacking section 50 is performed, the thickness of the sheet stack is measured (S4B). The information on the measured thickness is transmitted to the image forming apparatus A (T4).

Next, the book binding conditions stored in Step S1B are read and the coating conditions are set based on the read information (S5B).

The setting of the coating conditions in Step S5B and Step S6B is done with reference to the corresponding chart for paper type and coating frequency/coating roller rotation speed shown in Table 1 that are stored in the coating condition memory section 205 of the book binding apparatus control section B.

In the example that is shown, the coating frequency is set to be twice and coating roller rotation speed is 200 mm/s.

In S7B-S10B, coating in which 2 back and forth motions are done twice is performed, and in Step S11B the sheets are bonded in a sheet stack to form a booklet.

In step S12B, the booklet is ejected and the booklet creation signal T5 is transmitted from the book binding apparatus B to the image forming apparatus A at the same time as booklet ejection (S12B).

The set number of booklet is created by repeating the S31A-S12B and at the stage where book creation is complete, the set number of image forming apparatus A and book binding apparatus B perform job completion processing (S4A, S13B).

In the example of FIG. 4 and FIG. 5, the coating condition memory section 205 of the book binding apparatus B stores the corresponding chart of the coating conditions with paper type shown in Table 1 and the coating conditions are set based on the book binding conditions information from the image forming apparatus A, but the coating condition memory section may be provided in the image forming apparatus A, and in this case, the coating frequency and coating roller speed information is transmitted from the image forming apparatus A to the post processing apparatus and in the book binding apparatus B, coating is performed using the coating conditions from the image forming apparatus A.

When the coating frequency is increased, the time for the book binding processing step is made longer and thus the image forming apparatus control section 100 preferably calculates the time for book binding and the display section 111*c* displays it.

It is particularly preferable that when the book binding time is the normal time, the book binding time is not displayed while if the book binding time is more than a prescribed value, the time for book binding is displayed. The content of the display is the time used for one booklet or the total time, or alternatively a combination of both.

In addition, in this embodiment, both the coating frequency and the coating roller rotation speed are switched, but it is possible for only one of the coating frequency and the coating roller rotation speed to be changed when switching the coating amount. In the case where only the coating roller rotation speed is switched, the book binding time can be reduced.

In this embodiment, the coating amount of the adhesive on the spine of the sheet bundle is changed in accordance to paper type and thus even in the case where the types of paper used is different as is the case where regular paper and coated paper and the like are used, the sheets can be bonded with sufficient adhesive strength and it becomes possible to created a booklet which has sufficient strength.

In addition, the bond amount is controlled by adjusting the coating control, and a prescribed adhesive strength can be obtained without using special processing devices for increasing adhesive strength and thus it becomes possible to created a prescribed high quality booklet without increased cost for book manufacturing and book binding apparatus.

What is claimed is:

1. A book binding system comprising:

an image forming apparatus for forming an image on a sheet;

a book binding apparatus having a coating section for coating adhesive onto a spine of a sheet stack and forming a booklet by coating with the adhesive and binding a plurality of sheets on which images have been formed at the image forming device;

an operation and display section for inputting an operation and displaying a state of the book binding system;

an external communication section for communicating with an external device, wherein the external communication section receives a job command for executing a book forming from the external device;

a coating condition memory section;

and a coating control section for controlling a coating amount of the adhesive of the coating section in accordance with a sheet type representing a regular paper, a high grade paper, a coated paper and the like, wherein the coating amount when the sheet type is the high grade paper or the coated paper is larger than the coating amount when the sheet type is the regular paper, wherein the coating condition memory section memorizes the corresponding relation between the coating amount and the sheet type, and the coating control section decides the coating amount based on either one of a sheet type information inputted at the operation display section and the sheet type information included in the job command received through external communication section and on the corresponding relation between the coating amount and the sheet type memorized at the coating condition memory section.

2. The book binding system of claim 1, wherein the coating control section controls the coating amount by changing a frequency of coating.

3. The book binding system of claim 1, wherein the coating section comprising a coating roller for coating the adhesive onto the spine of the sheet bundle and the coating control section controls the coating amount by changing a rotation speed of the coating roller.

4. The book binding system of claim 1, wherein, in the case that a plurality of sheets for forming the booklet comprise a plurality of types of sheets, the coating control section determines the coating amount according to a sheet type which requires a largest amount of adhesive among the plurality of types of sheets.

5. The book binding system of claim 1 further comprising: a display section for displaying that a book binding time becomes long when a book binding time becomes long according to an increase of the coating amount.

6. The book binding system of claim 5, wherein the display section indicates a total time required for binding a book.

7. The book binding system of claim 1, wherein the coating control section can change a corresponding relation between the coating amount and the sheet type.

8. The book binding system of claim 7, wherein the coating control section can change the corresponding relation between the coating amount and the sheet type upon changing the adhesive.

9. The book binding system of claim 1, wherein the coating control section changes the coating amount by controlling at least one of the frequency of coating and the rotation speed of the coating roller.

10. An operation and display section for inputting an operation and displaying a state of the book binding system;

an external communication section for communicating with an external device, wherein the external communication section receives a job command for executing a book forming from the external device;

a coating condition memory section and a coating control section for controlling a coating amount of the adhesive of the coating section in accordance with a sheet type, wherein the coating condition memory section memorizes the corresponding relation between the coating amount and the sheet type, and the coating control section decides the coating amount based on either one of a sheet type information inputted at the operation display section and the sheet type information included in the job command received through external communication section and on the corresponding relation between the coating amount and the sheet type memorized at the coating condition memory section.

11. The book binding system of claim 10, wherein the coating control section controls the coating amount by changing a frequency of coating.

12. The book binding system of claim 10, wherein the coating section comprising a coating roller for coating the adhesive onto the spine of the sheet bundle and the coating control section controls the coating amount by changing a rotation speed of the coating roller.

13. The book binding system of claim 10, wherein, in the case that a plurality of sheets for forming the booklet comprise a plurality of types of sheets, the coating control section determines the coating amount according to a sheet type which requires a largest amount of adhesive among the plurality of types of sheets.

14. The book binding system of claim 10, further comprising: a display section for displaying that a book binding time becomes long when a book binding time becomes long according to an increase of the coating amount.

15. The book binding system of claim 14, wherein the display section indicates a total time required for binding a book.

16. The book binding system of claim 10, wherein the coating control section can change a corresponding relation between the coating amount and the sheet type.

17. The book binding system of claim 16, wherein the coating control section can change the corresponding relation between the coating amount and the sheet type upon changing the adhesive.

18. The book binding system of claim 10, wherein the coating control section changes the coating amount by controlling at least one of the frequency of coating and the rotation speed of the coating roller.

* * * * *